US005437389A

United States Patent [19]

Kaufman et al.

[11] Patent Number: 5,437,389

[45] **Date of Patent: * Aug. 1, 1995**

[54] BEVERAGE CONTAINER

[75] Inventors: Richard H. Kaufman, Chappaqua; Theodore J. Kovacic, Bedford, both of N.Y.; Hideyoshi Okita, Huntington Beach, Calif.; Martin M. Bostwick, Norwalk, Conn.; Andrew T. Kostanecki, Darien, Conn.; Robert H. Brainard, Danbury, Conn.; Patrick B. Nolan, Norwalk, Conn.

[73] Assignee: Kraft Foods, Inc., Northfield, Ill.

[ * ] Notice: The portion of the term of this patent subsequent to Jan. 31, 2012 has been disclaimed.

[21] Appl. No.: 958,408

[22] Filed: Oct. 8, 1992

Related U.S. Application Data

[63] Continuation-in-part of Ser. No. 958,670, Oct. 8, 1992, Ser. No. 958,396, Oct. 8, 1992, and Ser. No. 898,114, Jun. 12, 1992, which is a continuation-in-part of Ser. No. 776,444, Oct. 17, 1991.

[51] Int. Cl.[6] ..... B65D 25/00

[52] U.S. Cl. ..... 220/710; 206/217; 206/219; 215/229; 215/389

[58] Field of Search ..... 220/710; 206/229, 217; 215/1 A, 229

[56] References Cited

U.S. PATENT DOCUMENTS

| | | | |
|---|---|---|---|
| 2,516,728 | 7/1950 | Smith | 222/108 |
| 3,303,984 | 2/1967 | Jurena | 229/7 |
| 3,332,567 | 7/1967 | Pugh, Sr. | 215/100 |
| 3,347,401 | 10/1967 | Nataf | 215/1 |
| 3,462,061 | 8/1969 | Shore | 229/7 |
| 3,486,679 | 12/1969 | Pfahler | 229/7 |
| 4,301,926 | 11/1981 | Chung | 206/620 |
| 4,573,631 | 3/1986 | Reeves | 229/7 |
| 4,607,755 | 8/1986 | Andreozzi | 215/1 A |
| 4,669,608 | 6/1987 | Thompson | 206/217 |
| 4,712,702 | 12/1987 | Ayabe et al. | 220/90.2 |
| 4,830,204 | 5/1989 | Lin | 215/1 A |
| 4,982,854 | 1/1991 | Ichimiya | 215/1 A |
| 5,005,717 | 4/1991 | Oilar | 215/13.1 |
| 5,054,631 | 10/1991 | Robbins, III | 215/1 A |
| 5,078,286 | 1/1992 | Hashimoto | 215/1 A |

FOREIGN PATENT DOCUMENTS

| | | | |
|---|---|---|---|
| 2492769 | 4/1982 | France . | |
| 59-172168 | 11/1984 | Japan . | |
| 61-681553 | 6/1986 | Japan . | |
| 63-79337 | 5/1988 | Japan . | |
| 2-117334 | 9/1990 | Japan . | |
| 978901 | 1/1965 | United Kingdom | 229/130.1 |
| WO8504850 | of 1985 | WIPO . | |

*Primary Examiner*—Joseph Man-Fu Moy
*Attorney, Agent, or Firm*—Thomas R. Savoie; Thomas A. Marcoux

[57] ABSTRACT

A unitary beverage container includes a main body defining a container volume. A flexible straw is fluidly connected at a proximal end with the volume adjacent the bottom of the main body. The flexible straw also includes a distal end in the form of a hollow mouthpiece having a central aperture therein with the mouthpiece is located adjacent the top of the main body. In many configurations of the mouthpiece, the mouthpiece includes a cylindrical base portion from which levers extend. An attaching mechanism removably attaches the mouthpiece of the flexible straw to the top of main body and closes the aperture of the mouthpiece. The attaching mechanism includes a short hollow bridge extending from the aperture at the distal end of the flexible straw which is broken during removal of the flexible straw to uncover the aperture prior to use. The hollow bridge is connected to a hollow chamber which is attached to the top. A concavity in which the mouthpiece is received is provided at the top. The hollow chamber is permanently attached in some embodiments and removably attached in others. Various different configurations of the mouthpiece are provided for use with the various embodiments.

27 Claims, 12 Drawing Sheets

Fig. 14
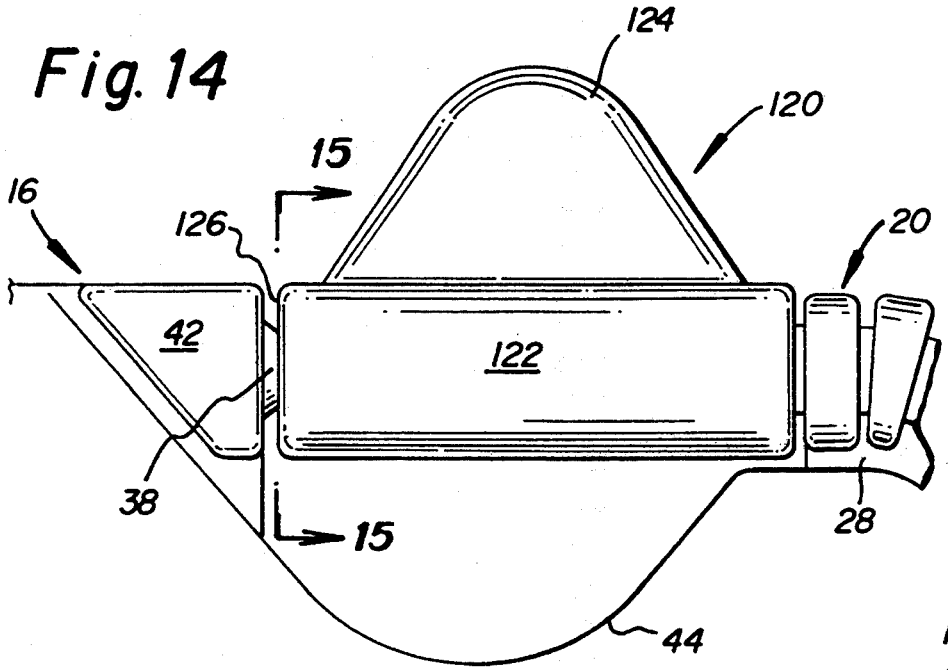
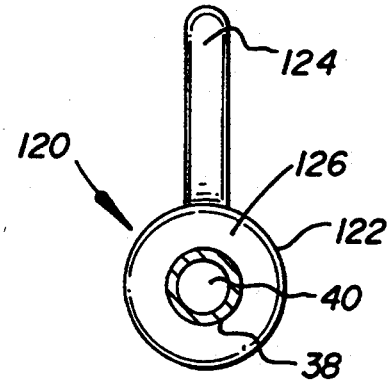
Fig. 15
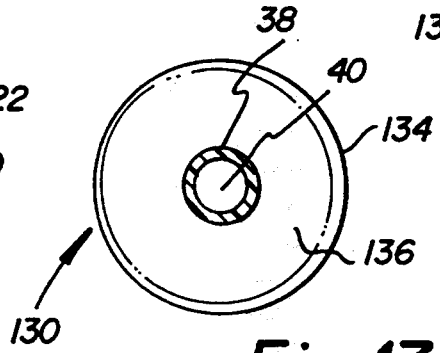
Fig. 17
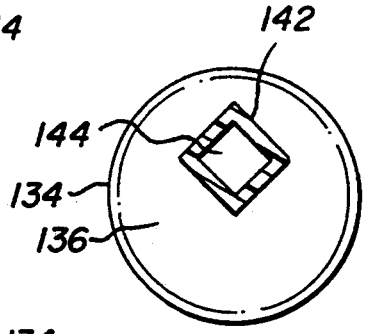
Fig. 18
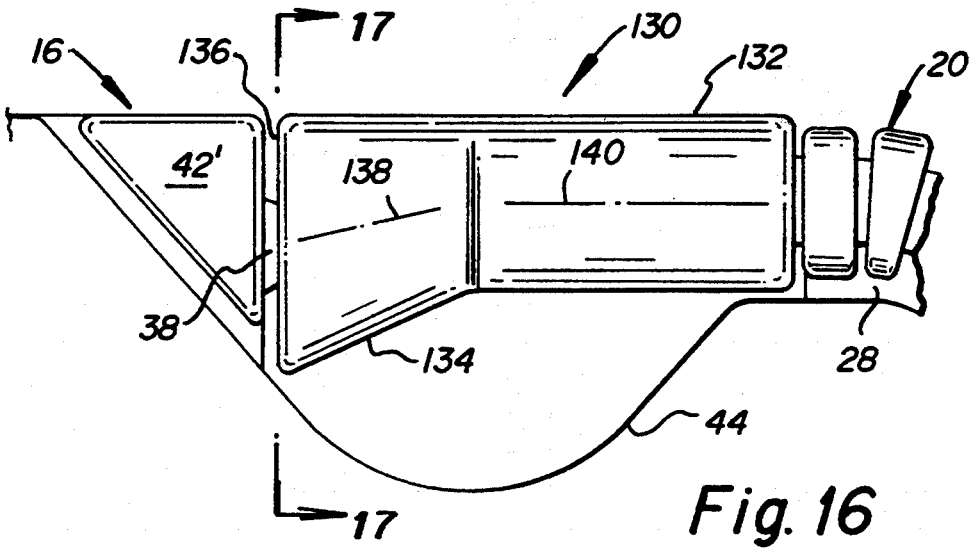
Fig. 16

Fig. 19
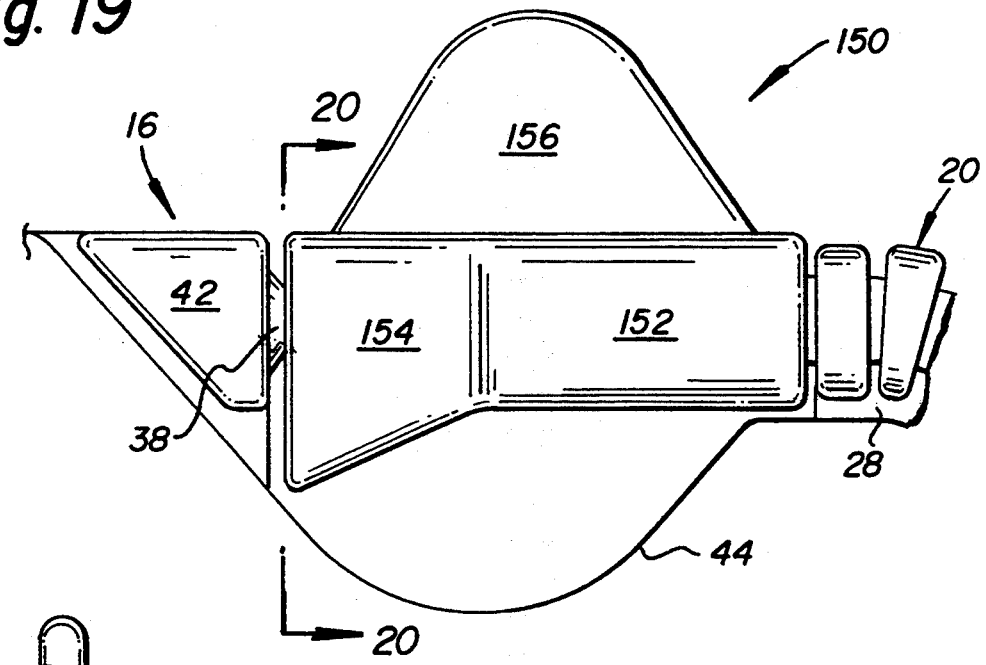
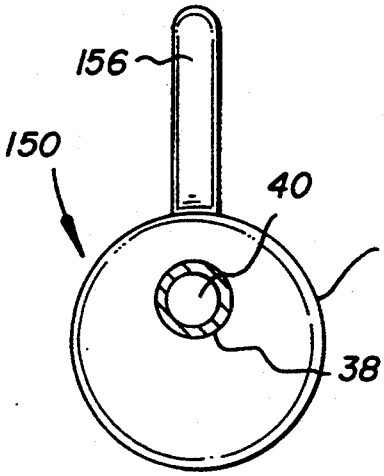
Fig. 20
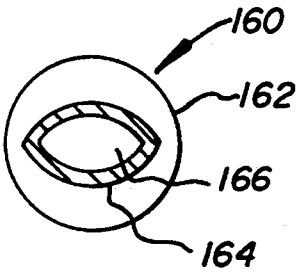
Fig. 22
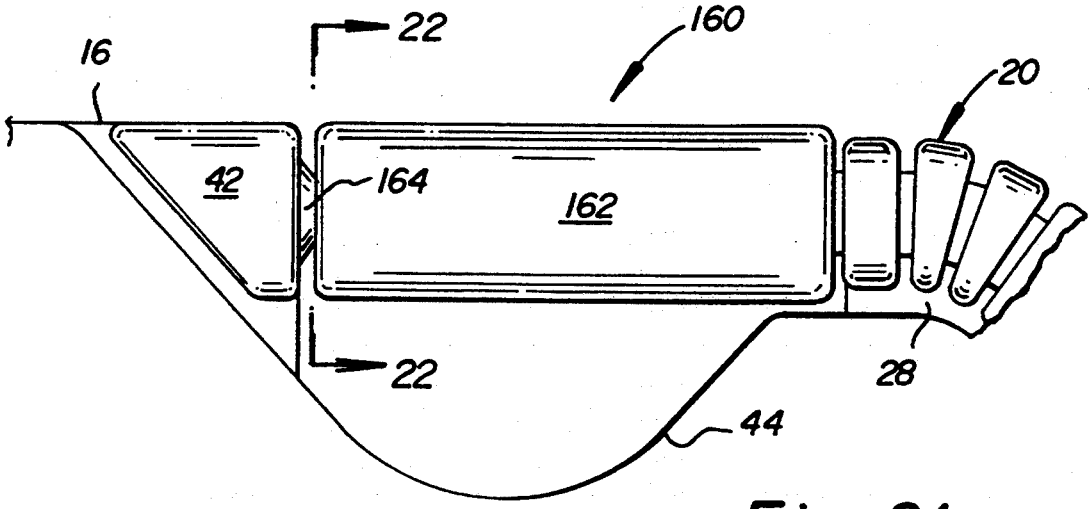
Fig. 21

Fig. 26
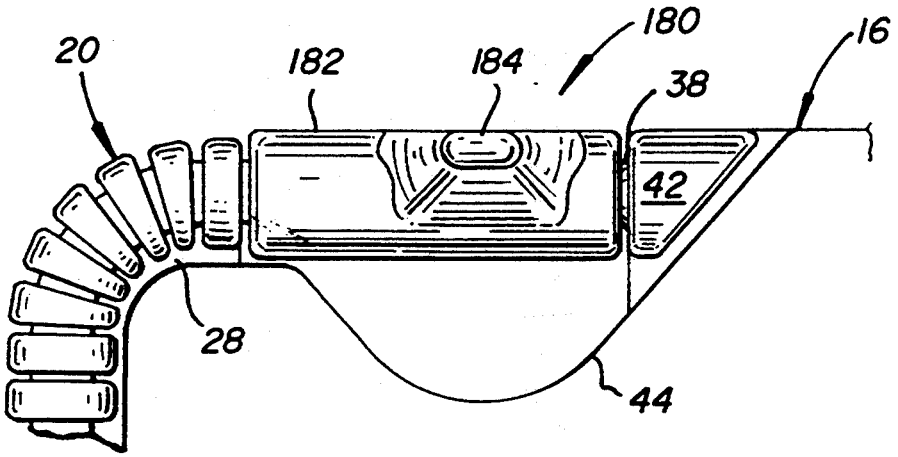
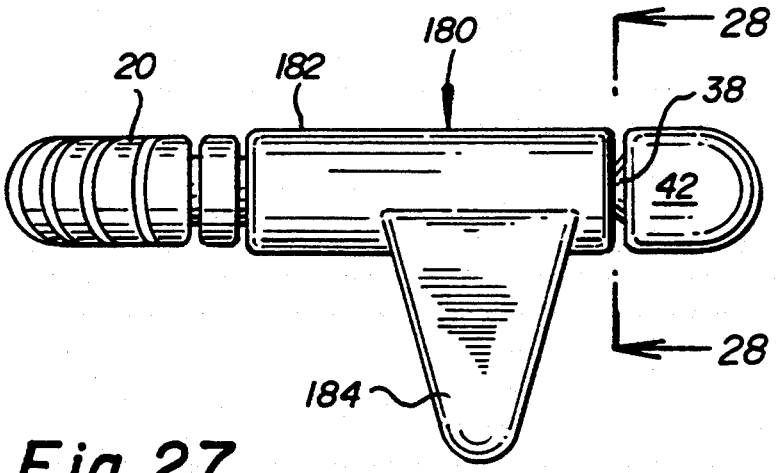
Fig. 27
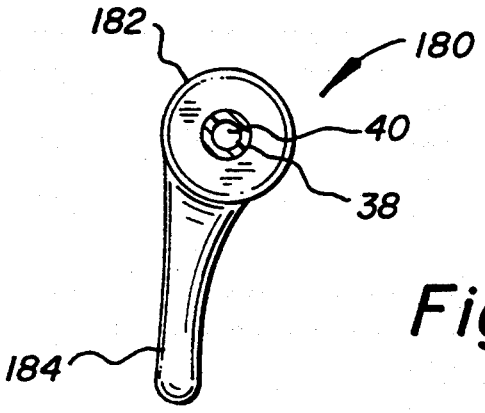
Fig. 28

BEVERAGE CONTAINER

RELATED APPLICATION

This application is a continuation-in-part of U.S. application Ser. No. 07/898,114, filed Jun. 12, 1992, which in turn is a continuation-in-part of U.S. application Ser. No. 07/776,444, filed Oct. 17, 1991, and which are hereby incorporated by reference. This application is a continuation in part of Ser. No. 958,670 and 958,396, all filed on Oct. 8, 1992.

FIELD OF THE INVENTION

The present invention relates generally to beverage containers, and more particularly to a one-piece or unitary beverage container with an integral straw.

BACKGROUND OF THE INVENTION

Many different beverages are provided in various containers. Of particular use by small children are small beverage containers which are accessed by a straw. Typically, the straw is removably attached to the outside of the container and is separately wrapped. Thus, the straw can be lost making the beverage hard to consume. In addition, the loose straw and wrapper for the straw are potential problems with small children who might accidentally try to swallow them. These loose items are also a trash nuisance as they tend to be dropped. Further, many of these small beverage containers are made from multi-ply laminates which include paper, foil and plastic and are therefore not easily recyclable.

A beverage container made of a synthetic resin and having a sipping tube or straw connected to the container bottom is disclosed in U.S. Pat. No. 4,982,854 (Ichimiya). A middle portion of the sipping tube is provided with a flexional bellows and the sipping tube is fitted into a longitudinal groove formed on the container body.

Other patents have also disclosed various integral sipping tubes or straws. Among these are the following U.S. Pat. Nos. 4,607,755 (Andreozzi), 4,573,631 (Reeves), 4,830,204 (Lin), 5,054,631 (Robbins) and 5,078,286 (Hashimoto). Other containers of general interest including various straw mounting means are shown in the following U.S. Pat. Nos. 5,005,717 (Oilar), 3,332,567 (Pugh, Sr.), 4,669,608 (Thompson), and 4,712,702 (Ayabe et al.).

SUMMARY OF THE INVENTION

In accordance with the present invention, a unitary beverage container is provided which includes a main body defining a container volume in which a beverage is contained. The main body includes a top and a bottom, and attached to the main body is a flexible straw. The flexible straw includes a proximal end with which the straw is fluidly connected to the container volume adjacent the bottom of the main body. The flexible straw also includes a distal end formed as a mouthpiece with an aperture therein which is located adjacent the top of the main body. An attaching means is then provided for removably attaching the mouthpiece of the flexible straw to the top of main body and for closing the aperture of the mouthpiece.

According to a preferred embodiment of the invention, the attaching means also includes a hollow connecting piece attached to the top and a short hollow bridge extending from the distal end of the flexible straw and about the aperture to the hollow connecting piece. This hollow bridge is broken during removal of the distal end of the flexible straw from the hollow piece whereby the aperture of the flexible straw is uncovered prior to use.

In a first preferred embodiment, the attaching means further includes a connection means for permanently attaching the hollow connecting piece to the top of the container. In addition, the top of the container includes a concavity adjacent the mouthpiece such that the mouthpiece is easily grasped and twisted about a longitudinal axis thereof to break the hollow bridge while leaving the hollow connecting piece attached to the top.

In one configuration, the mouthpiece includes a top wing and an opposed bottom wing, with the wings extending vertically from the longitudinal axis of the mouthpiece and with the bottom wing being located in the concavity. The mouthpiece includes a facing surface in which the aperture is located which is generally parallelogram-shaped in plan view. Alternatively, the mouthpiece includes a cylindrical base portion and the facing surface is generally circular shaped with upper and lower extensions in plan view.

In another configuration, the mouthpiece includes a lowermost surface located above a surface of said concavity and the top includes a stop means which extends vertically to the longitudinal axis of the mouthpiece from adjacent the lowermost surface to the surface of the concavity for stopping the mouthpiece from being forced vertically into the concavity. Preferably, this mouthpiece is formed with a cylindrical base portion which forms the lowermost surface and the stop means is formed by (a) a wall member which is spaced slightly from the lowermost surface of the cylindrical base portion and which vertically fills substantially all of the concavity below the lowermost surface of the cylindrical base portion and (b) a hinge means for hingedly connecting the wall member to the surface of the concavity such that the wall member is movable horizontally as the mouthpiece is twisted.

In still another configuration where the mouthpiece includes a cylindrical base portion, the cylindrical base portion has an expanded end segment adjacent the aperture. In one design, the expanded end segment is generally circular-shaped in lateral cross section with a central longitudinal axis which extends downwardly from a cylindrical axis of the base portion and with a radius of adjacent lateral cross sections which increases in size from a radius of the cylindrical base portion to a maximum adjacent the aperture. The mouthpiece can also include a top wing which extends vertically from the longitudinal axis of the mouthpiece. The expanded end segment is generally diamond shaped in lateral cross section and preferably elongated in a horizontal axis thereof. Alternatively, the mouthpiece includes a wing extending horizontally therefrom. Such a horizontal wing can extend centrally from the longitudinal axis of the mouthpiece or horizontally from a top of the mouthpiece.

In other embodiments, the attaching means further includes a connection means for removably attaching the hollow connecting piece to the top of the container. Thus, after removal of the hollow connecting piece from the top, the hollow connecting piece is twisted about a longitudinal axis of the mouthpiece to break the hollow bridge and separate the hollow connecting piece from the mouthpiece.

In a second preferred embodiment, the connection means is a thinly formed connection between the hollow connecting piece and the top. The top then further includes a corner and an indentation adjacent the corner in which the hollow connecting piece is located. The flexible straw extends across the top to the corner. Preferably, the hollow connecting piece is shaped as a connection elbow.

In a third preferred embodiment, the connection means is an engaging means for resiliently engaging the hollow connecting piece to the top. The top then further includes a longitudinal indentation along one side in which the engaging means is located, and the flexible straw extends along the indentation. Preferably, the hollow connecting piece is shaped as a ring, and the engaging means is a circular projection located in the indentation about which the ring is received.

To effect filling of the beverage container, a filling tube or aperture may be provided which after filling may be crimped, sealed or otherwise closed off. After closure of a filling tube, excess material may be removed and, as shown in U.S. Pat. No. 5,078,286, hereby incorporated by reference, the filling tube may be inverted into the main body of the container in order to provide a bottom surface free of projections. Another filling technique is as shown and described in the above-mentioned U.S. Pat. No. 4,982,854, hereby incorporated by reference, wherein a flanged filling aperture recessed within the bottom surface is sealed with an adhesive film after filling.

It is an object of some embodiments of the present invention to provide a one-piece beverage container which does not have any loose parts even after opening which can become lost or accidentally ingested or swallowed by the user or others.

It is also an object of the present invention to provide a one-piece beverage container which is easy to make, fill, and use.

It is a further object of the present invention to provide a one-piece beverage container which stands up readily and which is easy to package together with other such beverage containers.

It is a still further object of the present invention to provide a beverage container which does not spill easily.

Another object of the present invention is to provide a beverage container and associated parts which are strong and which will not easily develop leaks.

Still another object of some embodiments of the present invention is to provide a hollow mouthpiece which has a cross-sectional flow area for the beverage which is greater than a cross-sectional flow area of the drinking conduit or straw so that a reservoir is provided in the mouthpiece to help reduce spilling should the beverage container be accidentally tipped over or squeezed.

Other features and advantages of the present invention are stated in or apparent from a detailed description of a presently preferred embodiment of the invention found hereinbelow.

BRIEF DESCRIPTION OF THE DRAWINGS

FIG. 14 is an elevation view of the top of a third alternative configuration of a beverage container according to the present invention.

FIG. 15 is a cross-sectional elevation view of the mouthpiece of the beverage container depicted in FIG. 14 taken along the line 15—15 in FIG. 14.

FIG. 16 is an elevation view of the top of a fourth alternative configuration of a beverage container according to the present invention.

FIG. 17 is a cross-sectional elevation view of the mouthpiece of the beverage container depicted in FIG. 16 taken along the line 17—17 in FIG. 16.

FIG. 18 is a cross-sectional elevation view of an alternative mouthpiece of the beverage container of FIG. 16.

FIG. 19 is an elevation view of the top of a fifth alternative configuration of a beverage container according to the present invention.

FIG. 20 is a cross-sectional elevation view of the mouthpiece of the beverage container depicted in FIG. 19 taken along the line 20—20 in FIG. 19.

FIG. 21 is an elevation view of the top of a sixth alternative configuration of a beverage container according to the present invention.

FIG. 22 is a cross-sectional elevation view of the mouthpiece of the beverage container depicted in FIG. 21 taken along the line 22—22 in FIG. 21.

FIG. 26 is an elevation view of the top of a eighth alternative configuration of a beverage container according to the present invention.

FIG. 27 is a top plan view of the mouthpiece depicted in FIG. 26.

FIG. 28 is a cross-sectional view of the mouthpiece of the beverage container depicted in FIG. 26 taken along the line 28—28 in FIG. 27.

DETAILED DESCRIPTION OF THE PREFERRED EMBODIMENTS

Figure 3:
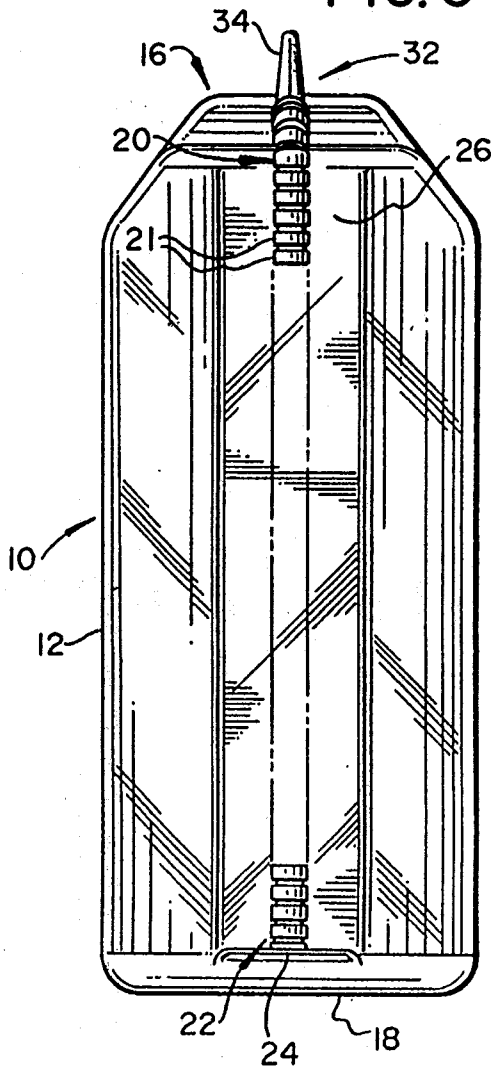
FIG. 3 is an elevation view of the filled beverage container depicted in FIG. 1 which has been rotated 45°.
Figure 2:
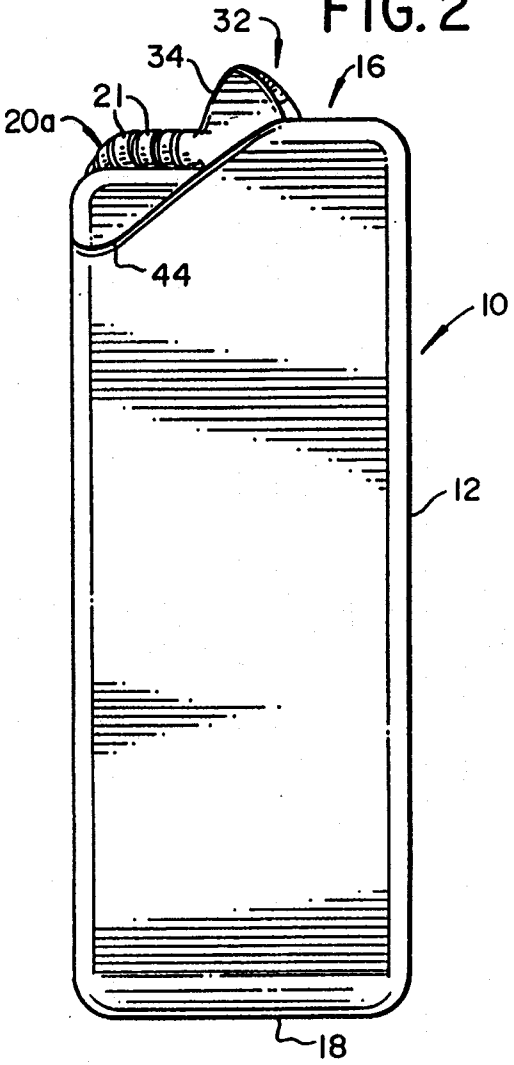
FIG. 2 is a rear elevation view of the filled beverage container depicted in FIG. 1.
Figure 1:
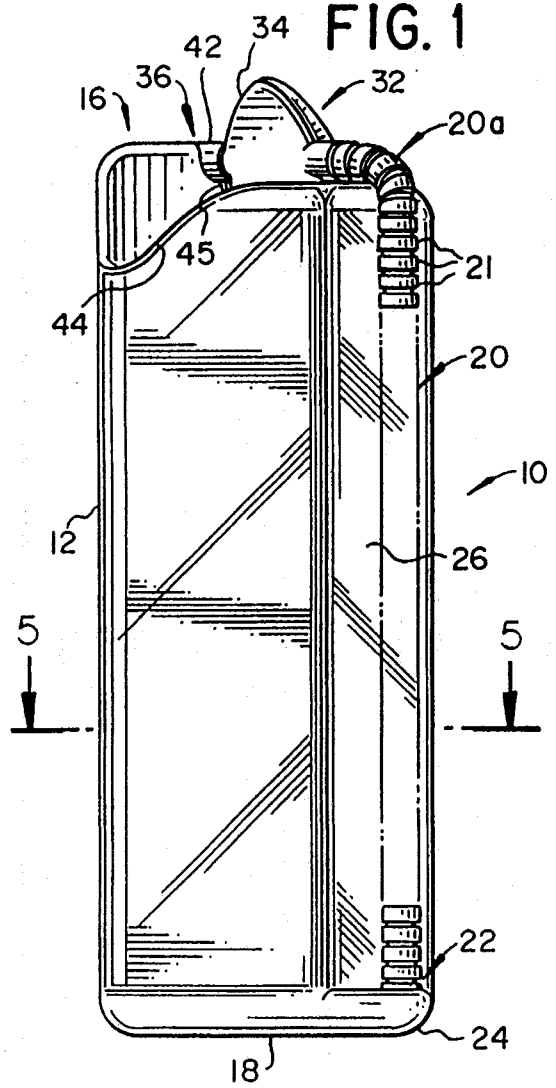
FIG. 1 is a front elevation view of a filled beverage container according to one embodiment of the present invention.

With reference now to the drawings in which like numeral represent like elements throughout the views, a beverage container 10 is depicted in FIGS. 1–5. Beverage container 10 is designed to be blow molded from a synthetic resin or plastic such as low density or high density polyethylene, as a unitary or one-piece container formed in a single operation. Beverage container 10 includes a main body 12 which is rectangularly shaped with rounded corners in plan view and which defines a container volume 14 in which a beverage is contained. Typically, such beverages are fruit juices, fruit-flavored drinks or the like. With such beverages, the material of beverage container 10 is usually translucent so that the liquid level can be seen, and the material is colored the same or similar to the color of the beverage contained. In addition, suitable indication or the like can be provided on the walls of main body 12 as part of the blow molding process if desired. Main body 12 has a top 16 particularly shaped as described subsequently and a bottom 18 which is peripherally flat and somewhat recessed inside of the periphery so that beverage container 10 stands upright easily in normal use.

Figure 6:
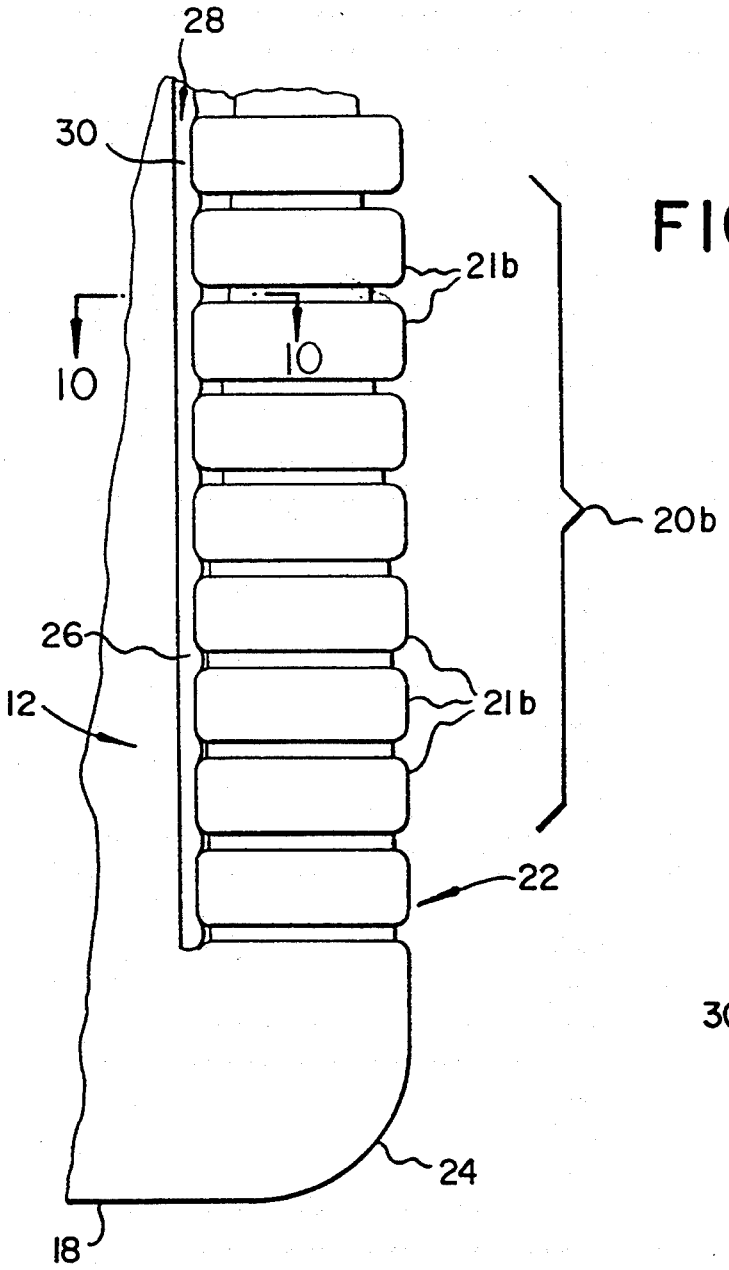
FIG. 6 is an elevation view of the corner of the beverage container where the straw is connected.

In order to access the beverage in volume 14 of main body 12, an integral sipping tube or straw 20 is provided which is formed to be easily bendable (as discussed in detail subsequently). As shown in greater detail in FIG. 6, straw 20 has a proximal end 22 which is integrally formed at a bottom corner 24 of main body 12. Straw 20 extends upwardly along a bevel surface 26 of main body 12 provided above corner 24 and between the two adjacent sides. As will be appreciated from FIG. 5, bevel surface 26 is sized so that straw 20 stays inside of the silhouette of main body 12 when viewed from the bottom.

Figure 7:
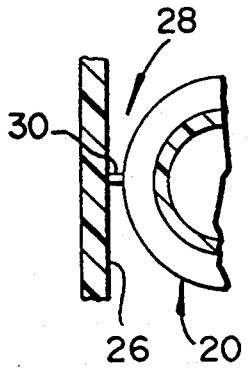
FIG. 7 is a cross-sectional plan view of the straw and adjacent main body portion taken along the line 7—7 in FIG. 6.

Straw 20 is removably attached to bevel surface 26 by an attaching means 28, which in this preferred embodiment is simply very thin connecting pieces forming an essentially continuous strip 30 between the outer portions of straw 20 and bevel surface 26 as shown best in FIG. 7. Preferably, these connecting pieces of strip 30 are simply formed in the blow molding process and are so thin as to be easily broken by the user when it is desired to detach all but proximal end 22 of straw 20 from main body 12.

Figures 8A, 8B:
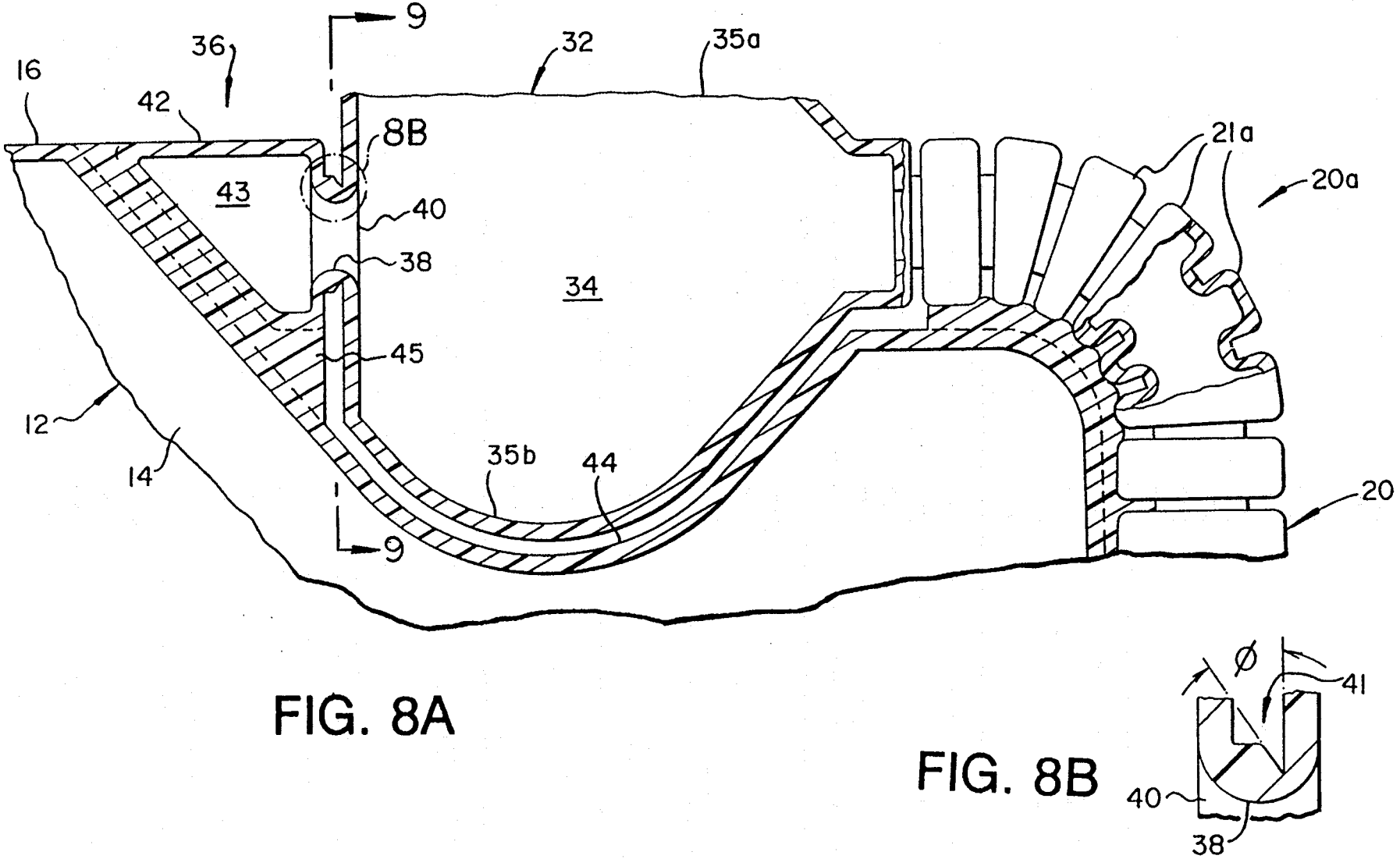
FIG. 8A is a cross-sectional elevation view of the top of the beverage container taken along the line 8—8 in FIG. 4.
FIG. 8B is an enlarged sectional view of a portion of the hollow bridge depicted in FIG. 8 indicated by the dashed circle 8'.
Figure 9:
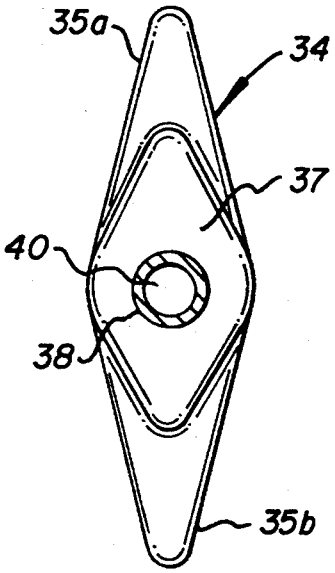
FIG. 9 is a cross-sectional elevation view of the mouthpiece of the beverage container depicted in FIG. 1 taken along the line 9—9 in FIG. 8.

Straw 20 also includes a distal end 32 which is shaped into a mouthpiece 34. Mouthpiece 34 is hollow and planar shaped as shown in FIG. 8 with an upper wing 35*a* (only part of which is shown) and a lower wing 35*b*. This configuration is designed to be easily retained in the mouth of a user, particularly young children. In addition, mouthpiece 34 is provided with wings 35*a* and 35*b* so that wings 35*a* and 35*b* can serve as a lever or twisting handle. By use of such a lever, mouthpiece 34 is easily detached from an attaching means 36 by which mouthpiece 34 is attached to top 16 of main body 12. As shown in FIG. 9, mouthpiece 34 has a facing or end surface 37 adjacent attaching means 36 which is formed in a generally diamond or parallelogram shape with rounded corners.

It will be appreciated that mouthpiece 34 has been depicted in a preferred shape, but that mouthpiece 34 can be provided in a variety of shapes as discussed subsequently and consistent with its use. Mouthpiece 34 could also be made smaller so long as mouthpiece 34 is provided with sufficient surface area to serve as a lever, and particularly the necessary finger gripping surface area for a thumb and forefinger.

Mouthpiece 34 with wings 35*a* and 35*b* is depicted as hollow and planar in a vertical plane, which is easy to provide as mouthpiece 34 (and the remainder of beverage container 10) is blow molded. This hollowness results in a small amount of air which is drawn into the mouth each time that the user sucks on straw 20. Thus, if desired, mouthpiece 34 could be made less hollow or even solid with just a tubular conduit therethrough. However, a hollow mouthpiece 34 is nonetheless preferred as such a configuration is more comfortable in the mouth. In addition, by making mouthpiece 34 hollow, this hollowness and overall planar shape also contribute to the stiffness of mouthpiece 34 necessary for wings 35*a* and 35*b* of mouthpiece 34 to serve as a lever. Further, the existence of the hollow volume within mouthpiece 34 will reduce spillage from the container as the container is being opened and from the opened container in the event the container is knocked over or accidentally squeezed as this hollow volume acts as a fluid reservoir. In particular, it will be appreciated that mouthpiece 34 and distal end 32 has a cross-sectional flow area (the cross-sectional area perpendicular to the direction of direct flow of the beverage from straw 20 to aperture 40) for the beverage which is greater than a cross-sectional flow area of straw 20 immediately prior to said mouthpiece 34 or said distal end 32. In other words, the volume of mouthpiece 34 or distal end 32 for the flow length between straw 20 and aperture 40 is greater than a volume of straw 20 for the same length of flow so that the reservoir is thus formed and provided in mouthpiece 34 or distal end 32.

As shown best in FIG. 8, attaching means 36 is essentially a short hollow bridge 38 extending from an aperture 40 provided in facing surface 37 of mouthpiece 34 to a connecting piece 42. The configuration of hollow bridge 38 is shown in greater detail in FIG. 8'. Thus, it will be appreciated that hollow bridge 38 is formed with a V-shaped notch 41 circumferentially thereabout which is radially directed toward a central longitudinal axis of hollow bridge 38 (and mouthpiece 34). Preferably, notch 41 is formed by an angle $\phi$ from vertical of about 30°. V-shaped notch 41 provides a localized weakening of hollow bridge 38 which is easily broken by twisting of mouthpiece 34. This V-shaped notch 41 or other thinned portion is easily formed in the molding process as the material flows about the mold piece.

The size of aperture 40 is not critical with respect to the sucking of the beverage from main body, although it obviously must be sufficient for a ready passage of a sufficient amount of the beverage when mouthpiece 34 is sucked on. However, the size of aperture 40 is important insofar as the larger the size, the greater the force which will be required to severe hollow bridge 38. Thus, a compromise is necessary for these competing objectives, and in beverage container 10 aperture 40 is preferably about 2 to 4 mm.

Connecting piece 42 of attaching means 36 is comprised of a hollow chamber 43 securely attached to a concavity or recess 44 provided in top 16 of main body 12 by a connecting means 45 which is preferably a solid connection in the form of a connecting wall. Hollow chamber 43 is hollow in order to form aperture 40 in mouthpiece 34 during the blow molding process as beverage container 10 is formed. In particular, during the blow molding process, aperture 40 is formed as air passes through aperture 40 in order to subsequently form hollow chamber 43 in connecting piece 42. Hollow chamber 43 is otherwise not in fluid communication with main body 12. Were connecting piece 42 not to include a hollow portion, the material forming connecting piece 42 would simply build up as a solid and aperture 40 would not be formed as desired.

It will also be appreciated that it is important for hollow chamber 43 not to be in fluid communication with main body 12 except through straw 20. One reason is that if hollow chamber 43 was in fluid communication with main body 12, after mouthpiece 34 was removed, hollow chamber 43 would be a source of leakage from main chamber 12 in the event the container is knocked over or excessively squeezed during or after opening.

Another reason for not having hollow chamber 43 in fluid communication with main body 12 other than through straw 20 is that leakage through straw 20 upon opening and in use is actually reduced by this construction. This reduction of leakage is due to the fact that the beverage in main body 12 must be withdrawn by sucking on mouthpiece 34. This suction creates a negative pressure within main body 12. Consequently, when the user lets go of mouthpiece 34 or otherwise opens aperture 40 to atmosphere a residual negative pressure in main body 12 results in the liquid in straw 20 being drawn back toward main body 12. Typically, about half of the distal portion of straw 20 is then not filled with the beverage, and this is true even though the beverage height in main body 12 may be higher than that in straw 20. Thus, even if beverage container 10 falls over or is accidentally place on its side, due to the small size of aperture 40 in mouthpiece 34 and the lack of any other path for air to get into main body 12, as well as the absence of any beverage near mouthpiece 34, there is not likely to be any leakage of the beverage from beverage container 10.

Figure 4:
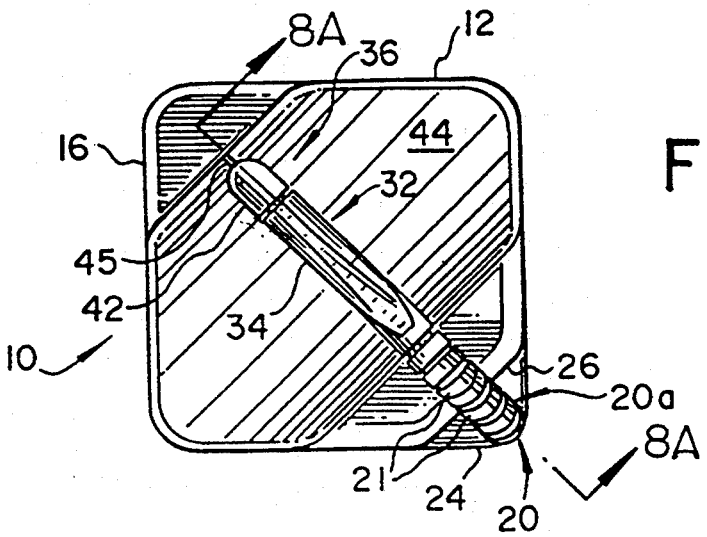
FIG. 4 is a top plan view of the beverage container depicted in FIG. 1.
Figure 5:
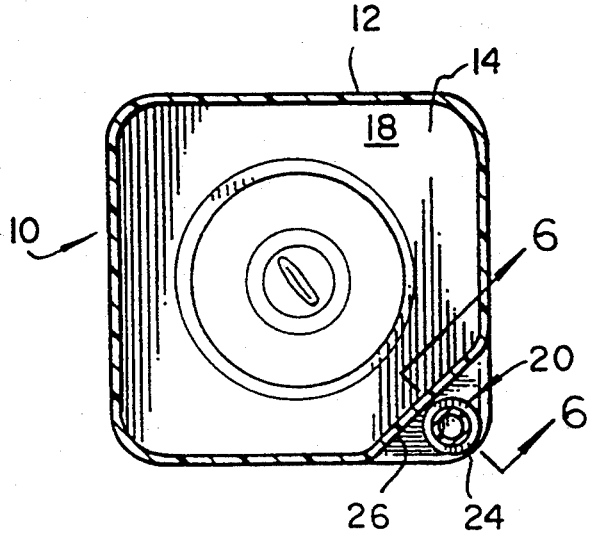
FIG. 5 is a cross-sectional view of the beverage container depicted in FIG. 1 and taken along the line 5—5.

As best shown in FIGS. 4 and 8, concavity 44 provided in top 16 of main body 12 extends along the entire corner-to-corner distance of top 16, and the shape of concavity 44 matches the profile of wing 35*b* of mouthpiece 34. As shown, top 16 of main body 12 is reduced in height at the side adjacent to straw 20 so that the height of top 16 at this position and the height of straw 20 (together with the minimal height of the connecting pieces of strip 30) together equal the height of the remainder of top 16. Thus, straw 20 is also contained in the profile of top 16 as shown in FIG. 3.

As mentioned above, mouthpiece 34 is easily detached from connection piece 42 by breaking hollow bridge 38 at notch 41. This is easily done by twisting mouthpiece 34 about its longitudinal axis (which is shared with the adjacent portion of straw 20), typically by placing a thumb on one side of wing 35*a* and a forefinger on an opposite side of wing 35*b*. Twisting by applying opposite forces to wings 35*a* and 35*b* causes hollow bridge 38 to nonelasticly deform and break at notch 41 so that mouthpiece 34 can be lifted out of concavity 44. At the same time that mouthpiece 34 is lifted, adjacent connecting pieces of strip 30 are easily severed. As will be described subsequently, the shape, size and orientation of wing or lever elements, as well as the number of wing or lever elements, may be varied. Generally at least one lever element extends from the distal end of the straw 20 to facilitate twisting of the straw in order to effect breaking of hollow bridge 38.

Straw 20, as shown, is comprised of a plurality of interconnected bellows-like segments 21. The precise place where the repeating segments of straw 20 should be considered to stop and start is arbitrary, and has been selected as depicted and described simply for clarity.

The configuration of segments 21 should be to allow straw 20 to bend easily and without developing leaks. Segments 21 are connected via connecting segments 23. Additionally, as shown in the drawings, segments 21*a* should possess a generally triangular or wedge shaped side profile (or lateral and radial cross-sectional profile as shown in the broken away portion of FIG. 8) at curved straw portion 20*a* where straw 20 forms the approximately 90° bend at the upper corner of main body 12. It should also be appreciated that because segments 21*a* are otherwise configured similar to segments 21, curved straw portion 20*a* is bendable in the same manner as the rest of straw 20. Thus, curved straw portion 20*a* can be substantially straightened by the user if it is desired for straw 20 to extend more or less straight.

While straw 20 is designed to be generally easily bendable, this is not true of stiffened straw portion 20*b* adjacent proximal end 22 of straw 20. Thus, as shown best in FIG. 6, the outer diameters of segments 23 are progressively smaller in an orderly manner to a minimum with increasing distance or height from proximal end 22. This causes segments 21*b* of stiffened straw portion 20*b* to become increasingly stiff the closer segment 21*b* is to proximal end 22, and thus stronger in order to withstand forces which would tend to concentrate thereat and pull stiffened straw portion 20*b* from corner 24 of main body 12.

In order to fill beverage container 10, beverage container 10 may be provided with a filling tube which may extend from bottom 18 or top 16 of main body 12. In a bottom filling operation, it will be appreciated that beverage container 10 is inverted from the orientation shown in the figures so that the beverage is easily introduced through the filling tube and retained in volume 14 by gravity. After filling, the end of the filling tube is sealed or crimped closed.

A benefit of filling inverted beverage container 10 through a bottom filling structure is that, as a result of lack of communication between hollow chamber 43 and main chamber 12, liquid does not flow into the straw so long as the fluid level does not rise to the proximal end 22 of straw 20. When container 10 is returned to its upright orientation air contained in straw 20 will prevent fluid from rising up in straw 20. Thus, with the initial opening of container 10 the likelihood of liquid being forced from distal end 32 of straw 20 is much reduced as both the empty volume within straw 20 and the empty volume within mouthpiece 34 would have to be overcome.

After opening of container 10 the fluid level in the straw remains depressed as a result of sub-atmospheric pressure present in the top headspace of main chamber 12. Low headspace pressure results from hot-filling of the liquid so that after sealing and cooling of container 10, a partial vacuum is formed. When a consumer sucks liquid from mouthpiece 34 and then releases mouthpiece 34 to the atmosphere, external pressure will act to depress the liquid level in straw 20. Thus it can be seen that as a result of the container structure and hot filling the inverted container through a bottom structure, spillage, which could result from excessive squeezing of container 10 or from accidental tipping of container 10, is greatly minimized.

In use, it will be initially appreciated that beverage container 10 is filled and sold to the consumer or user with a protective wrapping material (shrink wrap, plastic overlay, or the like) thereabout as well known by those of ordinary skill in the art. If desired, a number of beverage containers 10, such as six, can be bound together as a pack by the wrapping material. A cardboard sleeve may be positioned around such a pack inside of the wrapping material.

After removal from the wrapping material, the user simply twists mouthpiece 34. This is easily done due to the combined features of the flat shape of mouthpiece 34 with wings 35*a* and 35*b*, the concavity 44 provided, and the fact that wing 35*a* of mouthpiece 34 extends beyond straw 20. This twisting of mouthpiece 34 easily causes notch 41 of hollow bridge 38 to break or shear apart. When this occurs, aperture 40 of mouthpiece 34 is exposed, and mouthpiece 34 can be lifted from concavity 44. As mouthpiece 34 is lifted from concavity 44, the connecting portions of strip 30 attaching the adjacent segment of straw 20 to top 16 are also easily broken or severed. Similarly, by continued pulling on straw 20, the remaining connecting portions of strip 30 along bevel surface 26 are severed so that straw 20 can be moved by the user to any convenient position. In this position, the user simply sucks on mouthpiece 34 to drink the beverage in volume 14 of main body 12.

It should be appreciated that mouthpiece 34 is easily retained in the mouth of the user due to its flat shape, which is especially advantageous for young children. In addition, by making straw 20 flexible, the user can play with the straw which is also an attraction for young children. Further, it should be appreciated that there are no loose parts of beverage container 10 which could become lost or accidentally ingested or swallowed.

Figure 37:
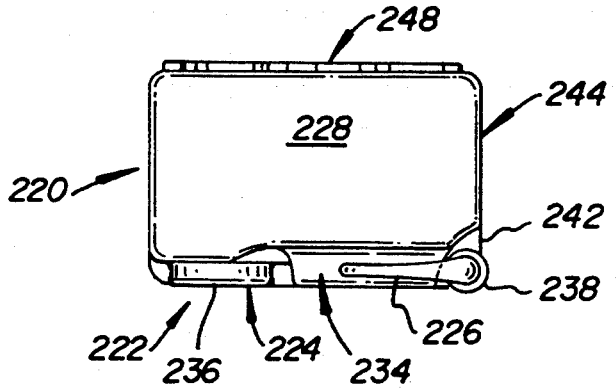
FIG. 37 is a top plan view of an third alternative embodiment of a beverage container according to the present invention.
Figure 38:
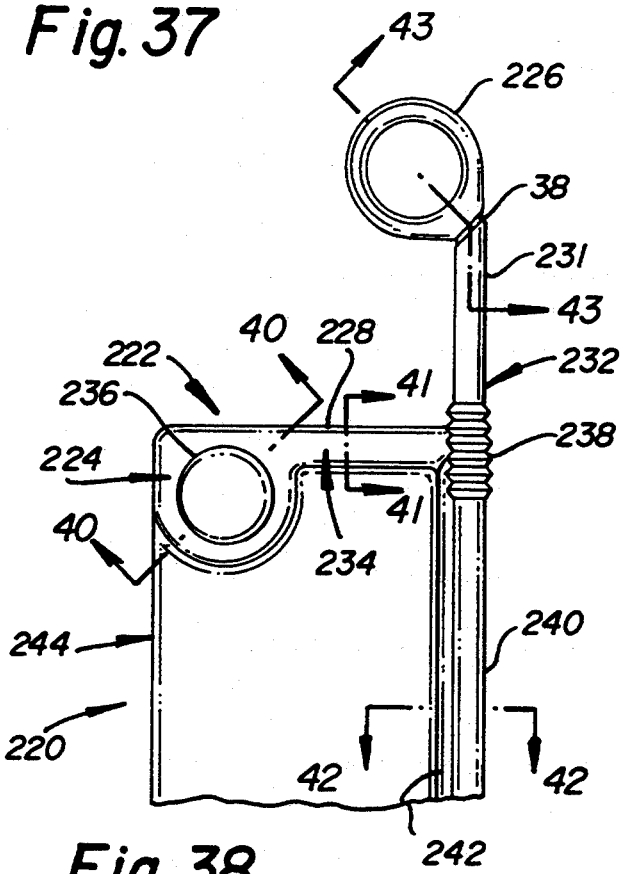
FIG. 38 is a front elevation view of the top of the beverage container depicted in FIG. 37.
Figure 39:
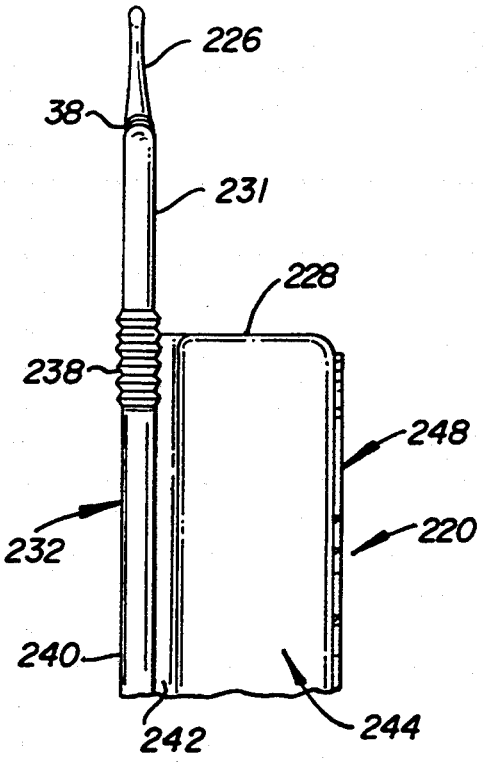
FIG. 39 is a right side elevation view of the top of the beverage container depicted in FIG. 37.
Figure 40:
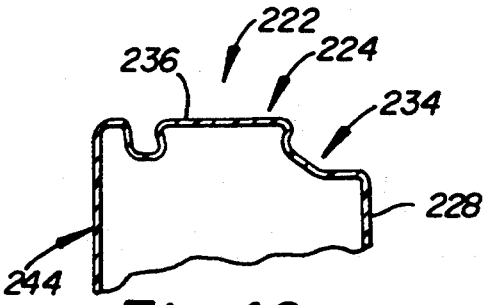
FIG. 40 is a cross-sectional view of the top of the beverage container depicted in FIG. 37 taken along the line 40—40 in FIG. 38.
Figure 41:
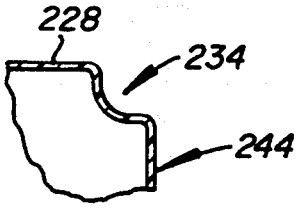
FIG. 41 is a cross-sectional view of the top of the beverage container depicted in FIG. 37 taken along the line 41—41 in FIG. 38.
Figure 42:
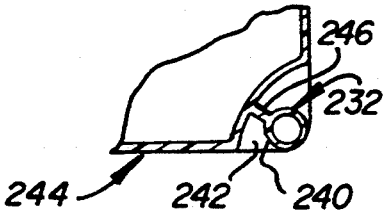
FIG. 42 is a cross-sectional view of the corner of the beverage container depicted in FIG. 37 taken along the line 42—42 in FIG. 38.

Depicted in FIGS. 10–43 are various alternative configurations of mouthpieces for beverage container 10 and alternative embodiments of beverage containers in accordance with the present invention. These mouthpieces and beverage containers are similar in many respects to mouthpiece 34 and beverage container 10, so that the similar features will not be discussed in detail and identical features will be provided with the same identifying numerals as used with beverage container 10. Further, where some features are not discussed or shown, it will be appreciated that these alternative beverage containers have similar features to beverage container 10. For example, the filling of the alternative beverage containers is not discussed hereinafter, but the alternative beverage containers would be filled in the same manner as discussed above for beverage container 10. Thus, although a bottom view is not shown of any of the alternative beverage containers, the bottom view would be essentially identical to that of beverage container 10 (with the only difference being that the plan outline shape of the embodiment shown in FIGS. 37–39 is rectangular as shown in the top plan view of FIG. 37 whereas that of beverage container 10 is square). It will also be appreciated that the alternative beverage containers are also similarly formed by blow molding with a suitable plastics material and that all edges and corners are rounded.

Figure 11:
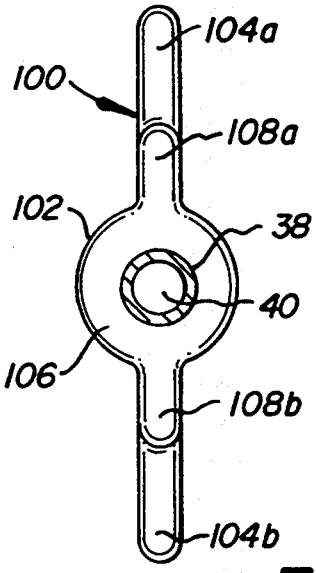
FIG. 11 is a cross-sectional elevation view of the mouthpiece of the beverage container depicted in FIG. 10 taken along the line 11—11 in FIG. 10.
Figure 10:
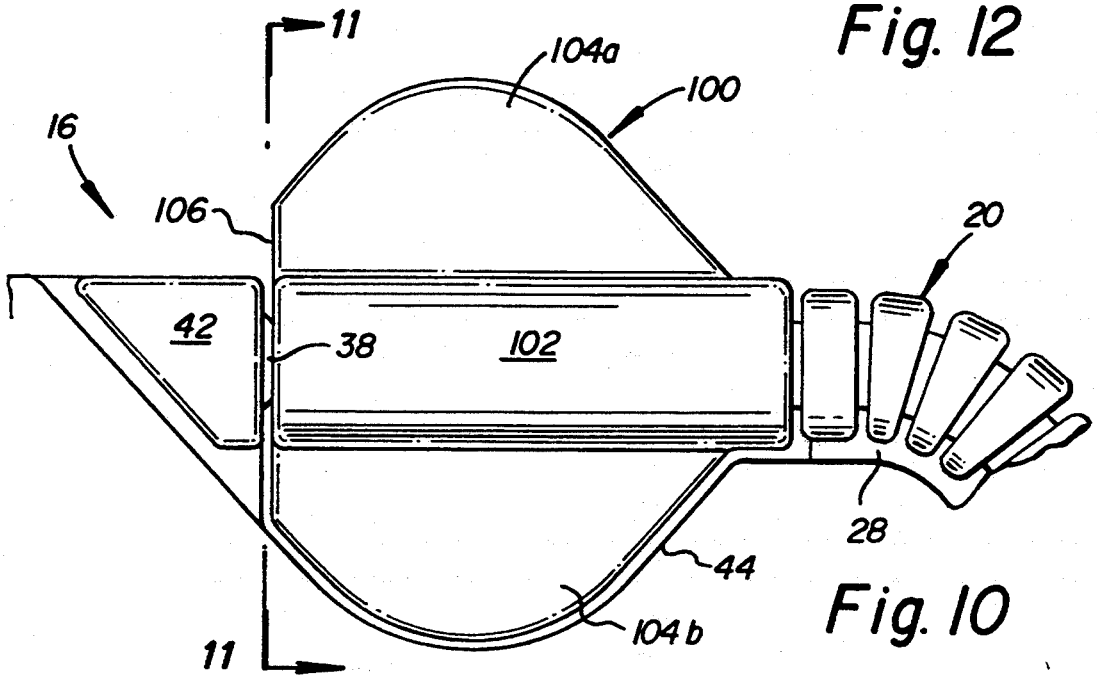
FIG. 10 is an elevation view of the top of a first alternative configuration of a beverage container according to the present invention.

With reference now to FIGS. 10–11, a first alternative configuration of a mouthpiece 100 for use with beverage container 10 in place of mouthpiece 34 is depicted. As shown, mouthpiece 100 includes a cylindrical base portion 102 which generally extends the cylindrical profile of straw 20 but with a slightly larger radius. Extending vertically from cylindrical base portion 102 is a generally planar upper wing 104*a* and a matching lower wing 104*b*. Wings 104*a* and 104*b* are shown as being formed as solids, but could be hollow or hollow in the portions adjacent cylindrical base portion 102. As shown in FIG. 11, mouthpiece 100 includes a facing or end surface 106 which is generally circular shaped with an upper extension 108*a* and a lower extension 108*b*. Extensions 108*a* and 108*b* are formed as part of the associated wings 104*a* and 104*b*. While mouthpiece 100 has a different configuration from mouthpiece 34, it will be appreciated that mouthpiece 100 would function in a similar manner to mouthpiece 34 when used with beverage container 10.

Figure 13:
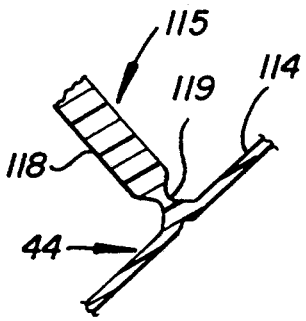
FIG. 13 is a cross-sectional view of a connecting member for the mouthpiece of the beverage container depicted in FIG. 12 taken along the line 13—13 in FIG. 12.
Figure 12:
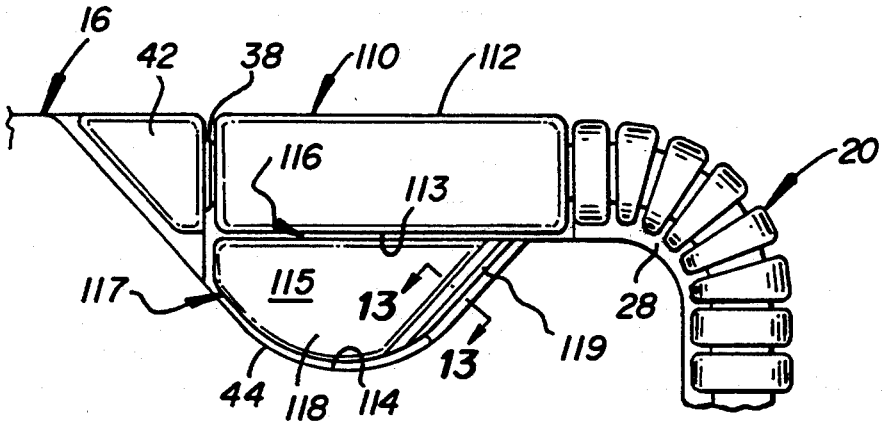
FIG. 12 is an elevation view of the top of a second alternative configuration of a beverage container according to the present invention.

With reference now to FIGS. 12–13, a second alternative configuration of a mouthpiece 110 for use with beverage container 10 in place of mouthpiece 34 is depicted. As shown, mouthpiece 110 includes a cylindrical base portion 112 which generally extends and expands the cylindrical profile of straw 20. Cylindrical base portion 112 includes a lowermost surface 113 which is spaced from a surface 114 of concavity 44. Top 16 then includes a stop means 115 which substantially fills the vertical space between cylindrical base portion 112 and surface 114 of concavity 44, leaving only gaps 116 and 117. Stop means 115 is thus provided for stopping mouthpiece 110 from being forced into concavity 44 due to rough handling or an accidental pushing downward which might cause bridge 38 to be accidentally broken. In other embodiments or configurations, it will be appreciated that a bottom wing or other downward segment (as discussed subsequently) which terminates adjacent the surface of concavity 44 would perform this same function as a stop means.

Preferably, stop means 115 is comprised of a wall member 118 which is solid as shown. Wall member 118 is attached to surface 114 of concavity in the location depicted by a hinge means 119. Hinge means 119 is conveniently formed by simply reducing the thickness of the material at the location thereof as shown. It will be appreciated that hinge means 119 is necessary so that wall member 118 is movable essentially in a horizontal plane perpendicular thereto. Thus, when the user grasps the sides of mouthpiece 110 to twist mouthpiece 110 about its longitudinal axis and break bridge 38, wall member 118 is free to move as the fingers gripping mouthpiece 110 move back and forth in concavity 44. Were it not for hinge means 119 and wall member 118 were immovable in the horizontal plane, it would be significantly more difficult to grip and twist mouthpiece 110 as the wall member would then prevent the user's fingers from freely rotating with mouthpiece 110. Thus, while mouthpiece 110 has a different configuration from mouthpiece 34, it will be appreciated that mouthpiece 110 would function in a similar manner to mouthpiece 34 when used with beverage container 10.

With reference now to FIGS. 14–15, a third alternative configuration of a mouthpiece 120 for use with beverage container 10 in place of mouthpiece 34 is depicted. As shown, mouthpiece 120 includes a cylindrical base portion 122 which generally extends and expands the cylindrical profile of straw 20. Extending vertically upward from cylindrical base portion 122 is a single wing 124 which is similar to wing 35*a*. As shown in FIG. 15, mouthpiece 120 includes a facing surface 126 which is generally circular shaped and with aperture 40 centered therein. While mouthpiece 120 has a different configuration from mouthpiece 34, it will be appreciated that mouthpiece 120 would function in a similar manner to mouthpiece 34 when used with beverage container 10. It should also be appreciated that wing 124 could alternatively be oriented to extend vertically downward from cylindrical base portion 122.

With reference now to FIGS. 16–17, a fourth alternative configuration of a mouthpiece 130 for use with beverage container 10 in place of mouthpiece 34 is depicted. As shown, mouthpiece 130 includes a cylindrical base portion 132 which generally extends and expands the cylindrical profile of straw 20 but which ends with an expanded end segment 134. As shown in FIG. 17, expanded end segment 134 of mouthpiece 130 ends with a facing surface 136 which is generally circular shaped and with aperture 40 centered therein. From FIGS. 16 and 17, it will also be appreciated that expanded end segment 134 is generally circular shaped in lateral cross section, that expanded end segment 134 includes a central longitudinal axis 138 which extends downwardly from a cylindrical axis 140 of base portion 132, and that a radius of expanded end segment 134 increases in size from that of base portion 132 to a maximum adjacent aperture 40 or bridge 38. To accommodate aperture 40 centered in facing surface 136, it will also be appreciated that connecting piece 42' is extended downwardly to a tip as opposed to connecting piece 42 which is cut off at this location. While mouthpiece 130 has a different configuration from mouthpiece 34, it will be appreciated that mouthpiece 130 would function in a similar manner to mouthpiece 34 when used with beverage container 10.

Depicted in FIG. 18 is an alternative design for a bridge 142 and aperture 144 to be used in place of bridge 38 and aperture 40 in mouthpiece 130 (or other mouthpieces of the present invention, as desired). As shown, bridge 142 and aperture 144 are square or diamond shaped rather than circular. In addition, it will be appreciated that bridge 142 and aperture 144 are centered about cylindrical axis 140 and thus are not centrally located in facing surface 136 as shown in FIG. 17 for bridge 38 and aperture 40. Obviously, bridge 142 would function in the same manner as bridge 38.

With reference now to FIGS. 19–20, a fifth alternative configuration of a mouthpiece 150 for use with beverage container 10 in place of mouthpiece 34 is depicted. As shown, mouthpiece 150 is similar to mouthpiece 130 and includes a cylindrical base portion 152 having an expanded end segment 154. In addition, and like mouthpiece 120, mouthpiece 150 includes wing 156 extending from cylindrical base portion 152 and expanded end segment 154. It will also be appreciated that, as shown, bridge 38 and aperture 40 are located about the longitudinal axis of cylindrical base portion 152 and are circular. While mouthpiece 150 has a different configuration from mouthpiece 34, it will be appreciated that mouthpiece 150 would function in a similar manner to mouthpiece 34 when used with beverage container 10.

With reference now to FIGS. 21–22, a sixth alternative configuration of a mouthpiece 160 for use with beverage container 10 in place of mouthpiece 34 is depicted. As shown, mouthpiece 160 is similar to mouthpieces 100 or 120 and includes a cylindrical base portion 162 but with no wings or extended segments or portions. It will also be appreciated from FIG. 22 that bridge 164 and aperture 166 are shaped in cross section as shown, which shape is that of intersecting circles. While mouthpiece 160 has a different configuration from mouthpiece 34, it will be appreciated that mouthpiece 160 would function in a similar manner to mouthpiece 34 when used with beverage container 10, though the twisting action would have to be directed only on cylindrical base portion 162 and thus there would be no additional lever effect. This would be satisfactory if bridge 164 were easy enough to break.

Figure 24:
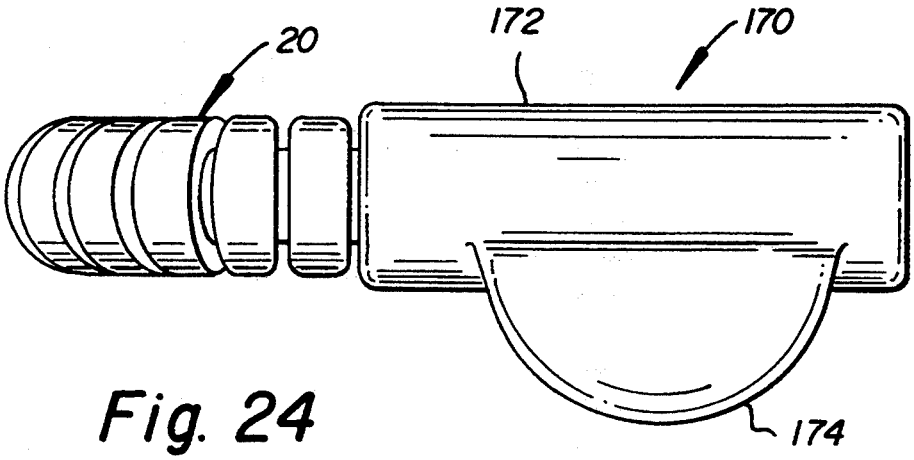
FIG. 24 is a top plan view of the mouthpiece depicted in FIG. 23.
Figure 23:
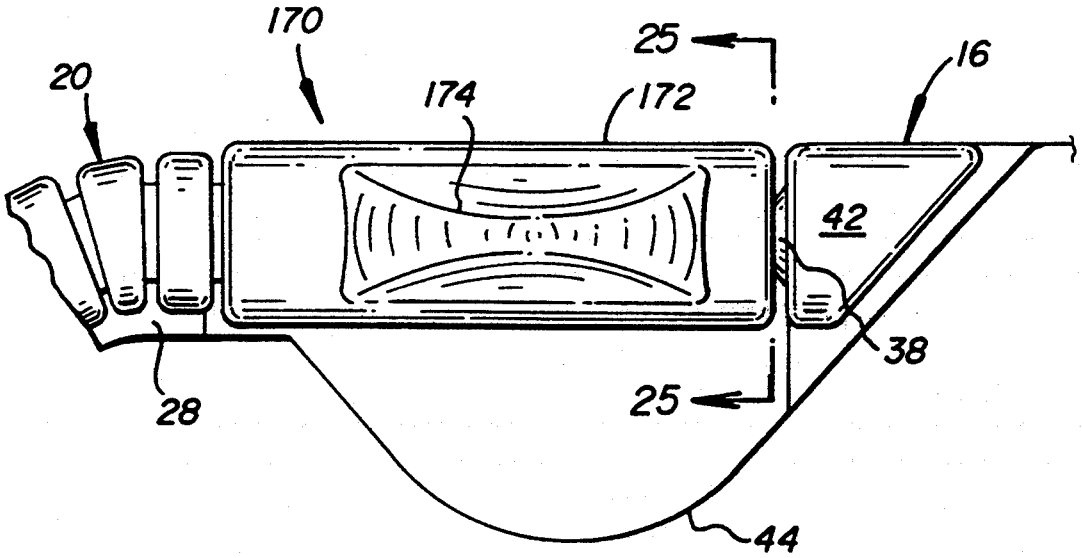
FIG. 23 is an elevation view of the top of a seventh alternative configuration of a beverage container according to the present invention.
Figure 25:
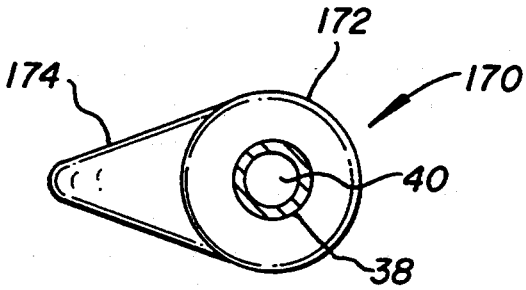
FIG. 25 is a cross-sectional elevation view of the mouthpiece of the beverage container depicted in FIG. 23 taken along the line 25—25 in FIG. 23.

With reference now to FIGS. 23–25, a seventh alternative configuration of a mouthpiece 170 for use with beverage container 10 in place of mouthpiece 34 is depicted. As shown, mouthpiece 170 is similar to many of the preceding mouthpieces and includes a cylindrical base portion 172 which generally extends and expands the cylindrical profile of straw 20. Extending horizontally and centrally from cylindrical base portion 172 is a generally vertically converging side wing 174 which is centrally scalloped and rounded at the tip as shown. Wing 174 is preferably formed hollow to serve as a reservoir the same as wings 35*a* and 35*b*, or at least partially hollow. While mouthpiece 170 has a different configuration from mouthpiece 34, it will be appreciated that mouthpiece 170 would function in a similar manner to mouthpiece 34 when used with beverage container 10.

With reference now to FIGS. 26–28, an eighth alternative configuration of a mouthpiece 180 for use with beverage container 10 in place of mouthpiece 34 is depicted. As shown, mouthpiece 180 is similar to mouthpiece 170 described above and thus includes a cylindrical base portion 182 which generally extends and expands the cylindrical profile of straw 20. Extending horizontally and from the top of cylindrical base portion 182 is a side wing 184. Side wing 184 is generally flat on the top, upwardly curved on the bottom, and comes to a rounded tip as shown as shown. Wing 184 is preferably formed hollow to serve as a reservoir the same as wings 35*a* and 35*b*, or at least partly hollow. While mouthpiece 180 has a different configuration from mouthpiece 34, it will be appreciated that mouthpiece 180 would function in a similar manner to mouthpiece 34 when used with beverage container 10.

Figure 29:
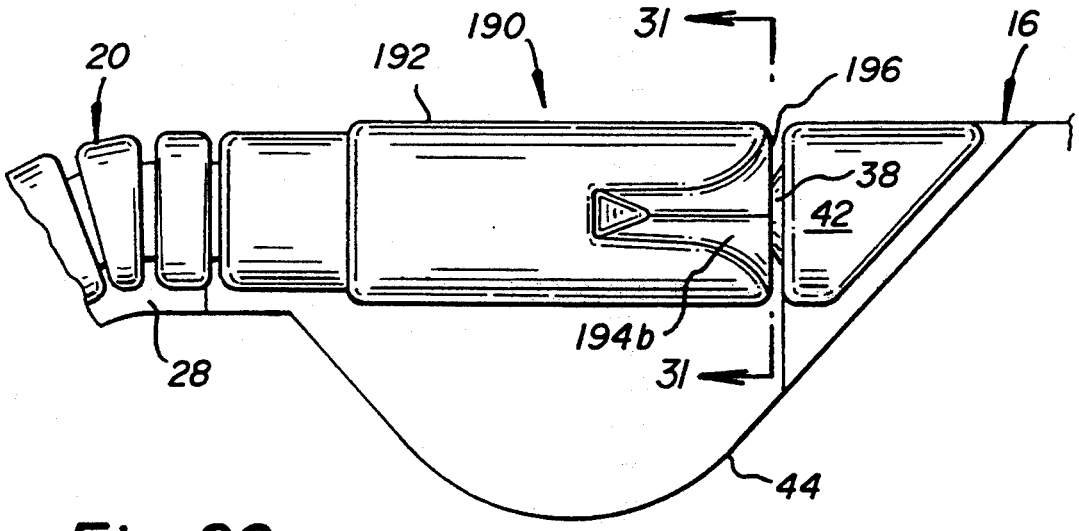
FIG. 29 is an elevation view of the top of a ninth alternative configuration of a beverage container according to the present invention.
Figure 30:
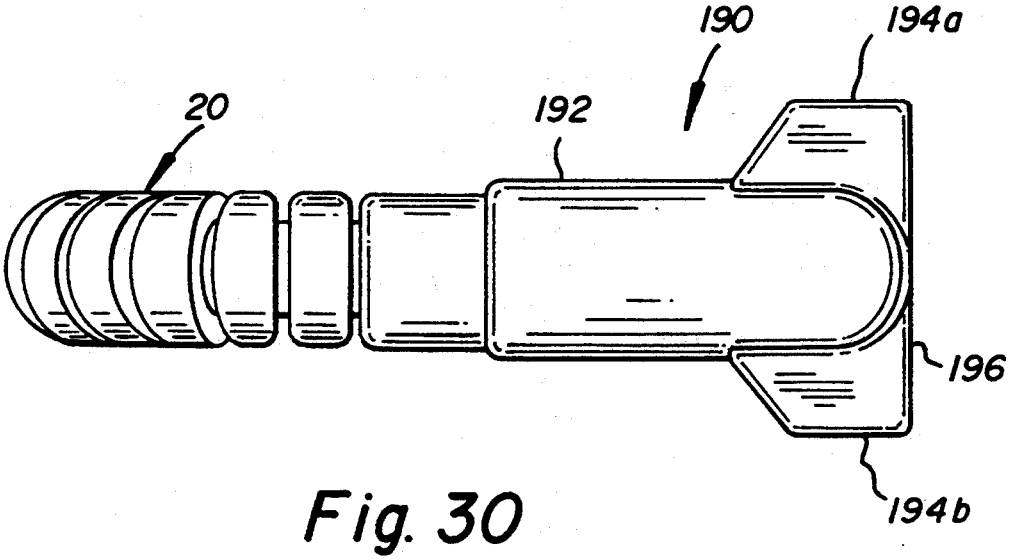
FIG. 30 is a top plan view of the mouthpiece depicted in FIG. 29.
Figure 31:
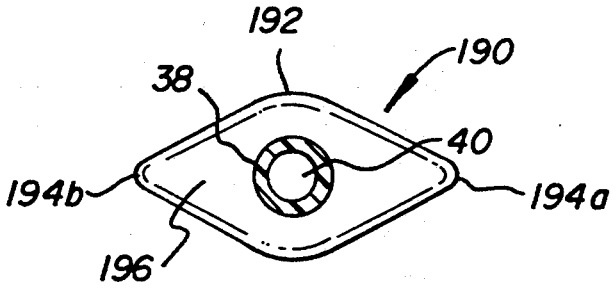
FIG. 31 is a cross-sectional elevation view of the mouthpiece of the beverage container depicted in FIG. 29 taken along the line 31—31 in FIG. 29.
Figure 32:
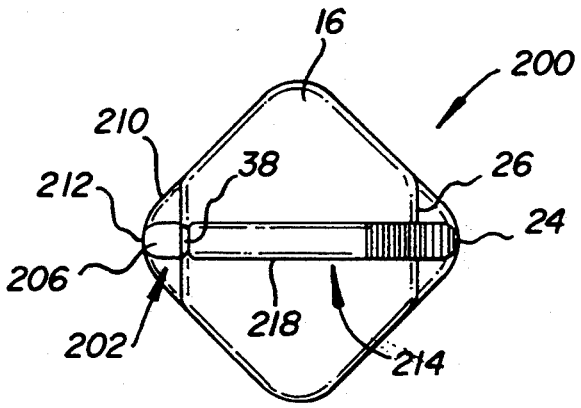
FIG. 32 is a top plan view of a second alternative embodiment of a beverage container according to the present invention which has been depicted rotated 45° in the same manner as FIG. 3 so that corners are presented in the center of the various elevation views described hereinafter.
Figure 33:
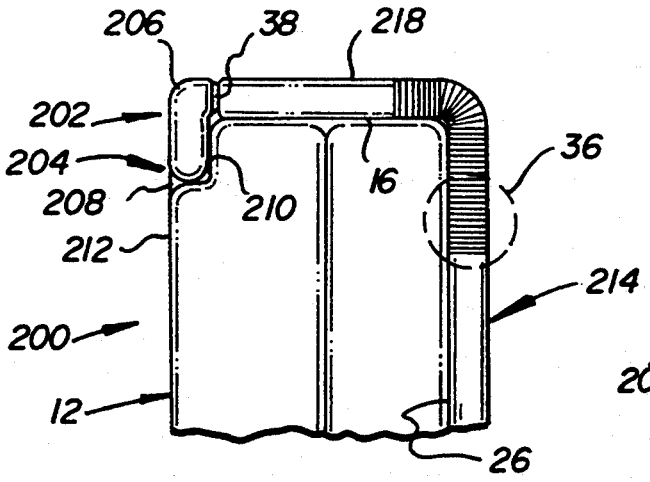
FIG. 33 is a front elevation view of the top portion of the beverage container depicted in FIG. 32.
Figure 34:
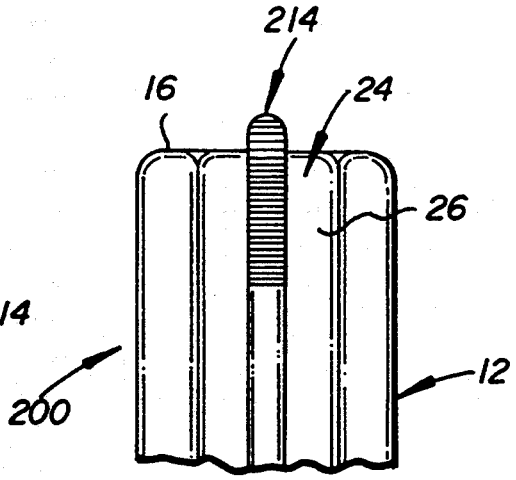
FIG. 34 is a right side elevation view of the top of the beverage container depicted in FIG. 32.
Figure 35:
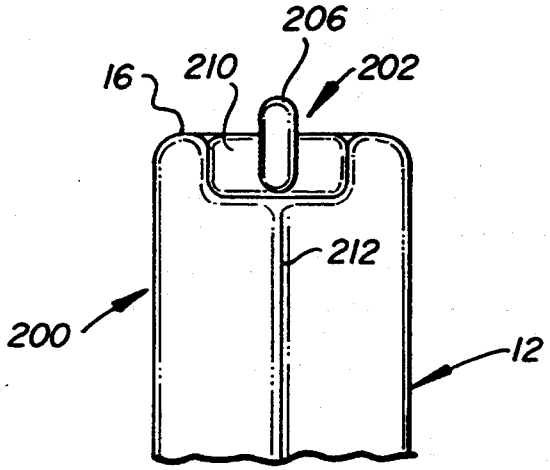
FIG. 35 is a left side elevation view of the top of the beverage container depicted in FIG. 32.
Figure 36:
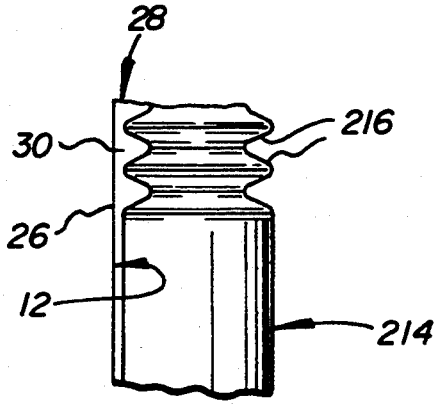
FIG. 36 is an enlarged view of the portion of the beverage container depicted in FIG. 33 surrounded by the dashed line 36.

With reference now to FIGS. 29–31, a ninth alternative configuration of a mouthpiece 190 for use with beverage container 10 in place of mouthpiece 34 is depicted. As with the preceding configurations, mouthpiece 190 includes a cylindrical base portion 192 which generally extends and expands the cylindrical profile of straw 20 but which ends with horizontally opposed and expanded end segments 194*a* and 194*b*. As shown in FIG. 31, expanded end segments 194*a* and 194*b* end with a facing surface 196 which is generally diamond shaped due to the position of expanded end segments 194*a* and 194*b* at facing surface 196. Bridge 38 and aperture 40 are centered in facing surface 196 as shown. While mouthpiece 190 has a different configuration from mouthpiece 34, it will be appreciated that mouthpiece 190 would function in a similar manner to mouthpiece 34 when used with beverage container 10.

With reference now to FIGS. 32–36, a second embodiment of a beverage container 200 which is broadly similar to beverage container 10 is depicted. Besides the similar elements to beverage container 10 identified with the same numerals, it will be appreciated that beverage container 200 includes an attaching means 202 which is different from attaching means 36 of beverage container 10. In particular, attaching means 202 includes a connection means 204 for removably attaching a hollow chamber 206 to top 16. Preferably, connection means 204 is simply a thinly formed connection 208. It will also be appreciated that hollow chamber 206 is formed as a connection elbow which is located in an indentation 210 of a corner 212 which is opposite from corner 24 in which straw 214 is located. Hollow chamber 206 also functions as a lever which can be twisted to facilitate breaking of hollow bridge 38. Thus, straw 214 extends across top 16 from corner 24 to corner 212.

Straw 214 is also configured somewhat differently from straw 20. A middle section of straw 214 is formed of accordion-like pleats 216 to provide the necessary bendability of straw 214 around the intersection of bevel surface 26 and top 16. Thus, straw 214 can either extend across top 16 as shown or be moved to a straight-up or other desired position as with straw 20. As with straw 20, straw 214 also includes an attaching means 28 which attaches straw 214 to bevel surface 26 and top 16. This attaching means 28 is formed as a strip 30, and strip 30 turns into connection 208 adjacent hollow chamber 206. It will also be appreciated that straw 214 has a mouthpiece 218 which extends from pleats 216 and which is the same configuration as the portion below pleats 216 so that a separately configured mouthpiece is not provided in this embodiment.

Beverage container 200 is used in essentially the same manner as beverage container 10. Thus, it will be appreciated that beverage container 200 is opened by twisting hollow chamber 206 about the axis of the adjacent mouthpiece 218 of straw 214 to break bridge 38. The downwardly depending portion of hollow chamber 206 functions as a lever for this purpose. As this is done, connection 208 is also broken and straw 214 is then separated from main body 12 except at the proximal end thereof where fluid connection is made to main body 12 (not shown). While the use of hollow chamber 206 provides a small and low profile attaching means 202 for beverage container 200, it should be appreciated that hollow chamber 206 is separated from the remainder of beverage container 200 and thus must be thrown away separately and that care should be taken that the separated hollow chamber 206 is not accidentally ingested by youngsters.

Figure 43:
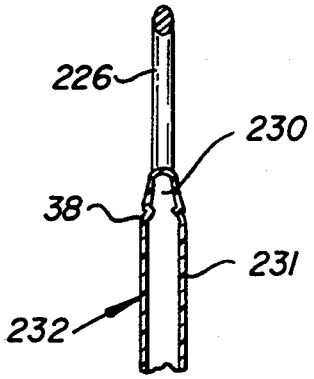
FIG. 43 is a cross-sectional view of the ring and straw of the beverage container depicted in FIG. 37 taken along the line 43—43 in FIG. 38.

With reference now to FIGS. 37–43, a third embodiment of a beverage container 220 which is broadly similar to beverage containers 10 and 200 is depicted. Besides the similar elements to beverage container 10 identified with the same numerals, it will be appreciated that beverage container 220 includes an attaching means including a connection means 222 which is different from attaching means 36 of beverage container 10 and attaching means 202 and connection means 204 of beverage container 200. In particular, connection means 222 includes an engaging means 224 for resiliently engaging a ring 226 to a top 228. As shown in FIG. 43, ring 226 is primarily solid, but includes a hollow chamber 230 immediately adjacent bridge 38 by which ring 226 is connected to a mouthpiece 231 of a straw 232. Top 228 includes a longitudinal indentation 234 along one side thereof in which straw 232 and ring 226 are received. In order to hold ring 226 and hence straw 232 resiliently in place on top 228 in indentation 234, a circular projection 236 is provided at one end of indentation 234 about which ring 226 is resiliently engaged prior to use. Ring 226 also functions as a lever which can be twisted to facilitate breaking of hollow bridge 38.

It will also be appreciated that straw 232 is located in indentation 234 and includes a bellow portion 238 as well as a lower portion 240 extending in a cut out corner 242. As with the other embodiments, straw 232 is attached to a main body 244 by a connection 246. In this embodiment, suitable indication 248 is provided along the side opposite from indentation 234.

Beverage container 220 is used in essentially the same manner as beverage container 200. Thus, it will be appreciated that beverage container 220 is opened by prying ring 226 away from circular projection 236 and then by twisting ring 226 about the axis of the adjacent mouthpiece 231 of straw 232 to break bridge 38. Straw 232 is then separated from main body 12 except at the proximal end thereof where fluid connection is made to main body 244. While the use of ring 226 provides a small and low profile connection means 222 for beverage container 220, it should be appreciated that ring 226 and its hollow chamber 230 are separated from the remainder of beverage container 220 and thus must be thrown away separately and that care should be taken that the separated ring 226 is not accidentally ingested by youngsters.

While the present invention has been described with respect to an exemplary embodiment thereof, it will be understood by those of ordinary skill in the art that variations and modifications can be effected within the scope and spirit of the invention. In particular, features of one embodiment or configuration can be incorporated in other embodiments or configurations as appropriate or desired.

What is claimed is:

1. A unitary, blow-molded beverage container comprising:

a main body defining a container volume in which a beverage is contained, said main body including a top and a bottom;

a flexible straw having a proximal end which is fluidly connected with the container volume adjacent said bottom of said main body and a distal end formed as a mouthpiece with an aperture and wherein said mouthpiece is located adjacent said top of said main body; and an attaching means for removably attaching said mouthpiece of said flexible straw to said top of said main body and for closing said aperture of said mouthpiece of said flexible straw, said attaching means including a hollow connecting piece attached to said top and a short hollow bridge extending from said distal end of said flexible straw and about said aperture to said hollow connecting piece, whereby said hollow bridge is broken during removal of said distal end of said flexible straw from said hollow connecting piece and thereby said aperture of said flexible straw is uncovered prior to use;

wherein, said attaching means further includes a connection means for permanently attaching said hollow connecting piece to said top of said container; and wherein said top of said container includes a concavity adjacent said mouthpiece such that said mouthpiece is easily grasped and twisted about a longitudinal axis thereof to break said hollow bridge while leaving said hollow connecting piece attached to said top.

2. A beverage container as claimed in claim 1 wherein said mouthpiece includes a lowermost surface located above a surface of said concavity; and wherein said top includes a stop means which extends vertically to the longitudinal axis of said mouthpiece from adjacent said lowermost surface to the surface of said concavity for stopping said mouthpiece from being forced vertically into said concavity.

3. A beverage container as claimed in claim 2 wherein said mouthpiece includes a cylindrical base portion which forms said lowermost surface.

4. A beverage container as claimed in claim 3 wherein said stop means includes (a) a wall member which is spaced slightly from said lowermost surface of said cylindrical base portion and which vertically fills substantially all of said concavity below said lowermost surface of said cylindrical base portion and (b) a hinge means for hingedly connecting said wall member to said surface of said concavity such that said wall member is movable horizontally as said mouthpiece is twisted.

5. A beverage container as claimed in claim 1 wherein said mouthpiece includes a cylindrical base portion.

6. A beverage container as claimed in claim 5 wherein said cylindrical base portion includes an expanded end segment adjacent said aperture.

7. A beverage container as claimed in claim 6 wherein said expanded end segment is generally circular shaped in lateral cross section with a central longitudinal axis which extends downwardly from a cylindrical axis of said base portion and with a radius of adjacent lateral cross sections which increases in size from a radius of said cylindrical base portion to a maximum adjacent said aperture.

8. A beverage container as claimed in claim 7 wherein said mouthpiece includes a top wing which extends vertically from the longitudinal axis of said mouthpiece.

9. A unitary, blow-molded beverage container comprising:

a main body defining a container volume in which a beverage is contained, said main body including a top and a bottom;

a flexible straw having a proximal end which is fluidly connected with the container volume adjacent said bottom of said main body and a distal end formed as a mouthpiece with an aperture and wherein said mouthpiece is located adjacent said top of said main body; and an attaching means for removably attaching said mouthpiece of said flexible straw to said top of said main body and for closing said aperture of said mouthpiece of said flexible straw, said attaching means including a hollow connecting piece attached to said top and a short hollow bridge extending from said distal end of said flexible straw and about said aperture to said hollow connecting piece, whereby said hollow bridge is broken during removal of said distal end of said flexible straw from said hollow connecting piece and thereby said aperture of said flexible straw is uncovered prior to use;

wherein at least one wing or lever element extends from said straw, said lever element facilitating twisting of the straw to effect breaking of the hollow bridge.

10. A beverage container as claimed in claim 9 wherein said mouthpiece includes a top wing and an opposed bottom wing which said wings extend vertically from the longitudinal axis of said mouthpiece with said bottom wing being located in said concavity.

11. A beverage container as claimed in claim 10 wherein said mouthpiece includes a cylindrical base portion from which said wings extend.

12. A beverage container as claimed in claim 9 wherein said mouthpiece includes a top wing which extends vertically from the longitudinal axis of said mouthpiece.

13. A beverage container as claimed in claim 12 wherein said mouthpiece includes a cylindrical base portion from which said top wing extends.

14. A beverage container as claimed in claim 9 wherein said mouthpiece also includes a wing extending horizontally therefrom.

15. A beverage container as claimed in claim 14 wherein said wing extends centrally from the longitudinal axis of said mouthpiece.

16. A beverage container as claimed in claim 14 wherein said wing extends horizontally from a top of said mouthpiece.

17. A unitary, blow-molded beverage container comprising:

a main body defining a container volume in which a beverage is contained, said main body including a top and a bottom;

a flexible straw having a proximal end which is fluidly connected with the container volume adjacent said bottom of said main body and a distal end formed as a mouthpiece with an aperture and wherein said mouthpiece is located adjacent said top of said main body; and an attaching means for removably attaching said mouthpiece of said flexible straw to said top of said main body and for closing said aperture of said mouthpiece of said flexible straw, said attaching means including a hollow connecting piece attached to said top and a short hollow bridge extending from said distal end of said flexible straw and about said aperture to said hollow connecting piece, whereby said hollow bridge is broken during removal of said distal end of said flexible straw from said hollow connecting piece and thereby said aperture of said flexible straw is uncovered prior to use;

wherein said attaching means further includes a connection means for removably attaching said hollow connecting piece to said top of said container such that after removal of said hollow connecting piece from said top said hollow connecting piece is twisted about a longitudinal axis of said mouthpiece to break said hollow bridge and separate said hollow connecting piece from said mouthpiece.

18. A beverage container as claimed in claim 17 wherein said connection means is a thinly formed connection between said hollow connecting piece and said top.

19. A beverage container as claimed in claim 18 wherein said top further includes a corner and an indentation adjacent said corner in which said hollow connecting piece is located; and wherein said flexible straw extends across said top to the corner.

20. A beverage container as claimed in claim 19 wherein said hollow connecting piece is shaped as a connection elbow.

21. A beverage container as claimed in claim 17 wherein said connection means is an engaging means for resiliently engaging said hollow connecting piece to said top.

22. A beverage container as claimed in claim 18 wherein said top includes a longitudinal indentation along one side in which said engaging means is located; and wherein said flexible straw extends along said indentation.

23. A beverage container as claimed in claim 22 wherein said hollow connecting piece is shaped as a ring; and wherein said engaging means is a circular projection located in said indentation about which said ring is received.

24. A unitary, blow-molded beverage container comprising:

a main body defining a container volume in which a beverage is contained, said main body including a top and a bottom;

a flexible straw having a proximal end which is fluidly connected with the container volume adjacent said bottom of said main body and a distal end formed as a mouthpiece with an aperture which said mouthpiece is located adjacent said top of said main body; and an attaching means for removably attaching said mouthpiece of said flexible straw to said top of said main body and for closing said aperture of said mouthpiece of said flexible straw, said attaching means including a hollow connecting piece, a connection means for attaching said hollow connecting piece to said top of said container, and a short hollow bridge extending from said distal end of said flexible straw and about said aperture to said hollow connecting piece, whereby said hollow bridge is broken during removal of said distal end of said flexible straw from said hollow piece and thereby said aperture of said flexible straw is uncovered prior to use;

wherein the distal end of said straw has a cross-sectional flow area for the beverage which is greater than the cross-sectional flow area of the straw so that a fluid reservoir is provided at said distal end of the straw; wherein said mouthpiece further includes a cylindrical base portion; wherein said connection means is a solid connection to said top which permanently holds said hollow connecting piece to said top; wherein said top of said container includes a concavity adjacent said mouthpiece such that said mouthpiece is easily grasped and twisted about a longitudinal axis thereof to break said hollow bridge while leaving said hollow connecting piece attached to said top; and wherein said mouthpiece includes a top wing which extends vertically from the longitudinal axis of said mouthpiece.

25. A beverage container as claimed in claim 24 wherein said mouthpiece further includes an opposed bottom wing which extends vertically from the longitudinal axis of said mouthpiece with said bottom wing being located in said concavity.

26. A beverage container as claimed in claim 24 wherein said cylindrical base portion includes an expanded end segment adjacent said aperture.

27. A beverage container as claimed in claim 26 wherein said expanded end segment is generally circular shaped in lateral cross section with a central longitudinal axis which extends downwardly from a cylindrical axis of said base portion and with a radius of adjacent lateral cross sections which increases in size from a radius of said cylindrical base portion to a maximum adjacent said aperture.

* * * * *